US005211386A

United States Patent [19]

Baba

[11] Patent Number: 5,211,386

[45] Date of Patent: May 18, 1993

[54] RECIRCULATION-TYPE AUTOMATIC DOCUMENT FEEDING DEVICE

[75] Inventor: Kenji Baba, Kofu, Japan

[73] Assignee: Nisca Corporation, Yamanashi, Japan

[21] Appl. No.: 799,990

[22] Filed: Nov. 29, 1991

[30] Foreign Application Priority Data

Nov. 30, 1990 [JP] Japan ..... 2-340817
Nov. 30, 1990 [JP] Japan ..... 2-340818

[51] Int. Cl.[5] ..... B65H 31/24

[52] U.S. Cl. ..... 271/3.1; 271/301; 271/902

[58] Field of Search ..... 271/902, 301, 3.1

[56] References Cited

U.S. PATENT DOCUMENTS 4,579,326 4/1986 Pinckney ..... 271/902 X
4,579,444 4/1986 Pinckney et al. ..... 155/14 SH
4,864,366 9/1989 Saeki ..... 355/235
4,949,949 8/1990 Holmes ..... 271/902 X
5,026,044 6/1991 Ryon et al. ..... 271/227

FOREIGN PATENT DOCUMENTS 63-47242 2/1988 Japan .
2-236137 9/1989 Japan .
2-158728 6/1990 Japan .

*Primary Examiner*—Richard A. Schacher
*Attorney, Agent, or Firm*—Oblon, Spivak, McClelland, Maier & Neustadt

[57] ABSTRACT

A recirculation-type document feeding device for a copying machine having a function of allowing a copied document to be alternatively discharged to a discharge tray or returned to a document tray. In a case of copying several times, the documents stacked on the document tray are transferred one by one to a document setting portion on a platen to be copied, and then, sent back to the document tray through a return passage. After copying completely, the copied documents may be eliminated to the discharge tray.

7 Claims, 6 Drawing Sheets

RECIRCULATION-TYPE AUTOMATIC DOCUMENT FEEDING DEVICE

BACKGROUND OF THE INVENTION

1. Field of the Invention

This invention relates to an automatic document feeding device capable of automatically feeding documents stacked on a document tray one by one to a document setting portion defined on a platen in a copying machine and sending back the document after copying from the document setting portion to the document tray, so as to repeat the copying operation for each document. More particularly, this invention relates to a recirculation-type document feeding device having a function of alternatively feeding the copied document from the document setting portion to a document discharge tray or the document tray.

2. Description of the Prior Art

Not infrequently there are cases that a plurality of original documents are repeatedly fed several times one by one to a document setting portion of a copying machine to be copied, consequently obtaining copied matters for binding books. At that time, it may be advantageous to consecutively make copies of the given documents by one volume in order to facilitate page numbering of the copied matters. To automatically repeat the copying operation for the original documents volume by volume, the copied documents are required to be sent back to a document tray on which the documents are initially stacked.

Automatic document feeding devices of this type have been so far proposed by Japanese Patent Application Public Disclosures Nos. SHO 60(1985)-113225, HEI 1(1989)-231739 and HEI 1(1989)-288542, U.S. Pat. No. 4,234,180 (corresp. to Japanese Pat. Appln. Pub. Discl. No. SHO 56(1981)-6263), and U.S. Pat. No. 4,699,365.

The conventional document feeding devices noted above are all adapted to repeat simplex copying operation for copying a plurality of original documents each having an image to be copied on one side. In these conventional devices, original documents are stacked on a document tray and automatically fed one by one from the document stack on the document tray to a document setting portion on a platen while drawing out the lowermost document from the document stack. The original document in the document setting portion after copying is merely sent back to and put on the stack of original documents which are not yet copied (uncopied documents). A mechanism for separating the copied documents returning to the document tray and the uncopied documents remaining on the document tray has been formerly proposed by Japanese Patent Appln. Public Disclosure No. SHO 60(1985)-48854. This mechanism has a function of counting the documents sent back to the document tray to decide completion of copying the required number of documents.

In any conventional document feeding device, after copying the required number of documents, the documents are all sent back to the document tray. This means that it would be next to impossible to take out even one copied document from the stacked documents on the document tray until completing the copying for all the given documents, because the decision as to whether, for example, the first document has been copied required times is difficult.

In a case that many documents are required to be copied during a busy time, there has been often felt a disadvantage such that any document cannot be taken out from the stacked documents on the document tray until completing the copying of all the documents required times. Thus, there has been a need for a document feeding device capable of discriminating the copied documents from the documents stacked on the document tray and taking out only the copied documents during copying as occasion demands. Besides, the documents sent back to the document tray after copying are required to be taken out in the initial order of page. A document feeding device having a function of fulfilling these requirements would be complicated in structure and increased in size.

Of the document feeding device of the type such that original documents to be copied can be automatically recirculated, there has conventionally been no device capable of duplex copying. That is, it has been impossible to repeatedly copy a plurality of documents each having images on both sides to obtain a plurality of volumes of copied matters arranged properly in order of page.

Furthermore, generally in the conventional copying machine, an optical scanning system disposed under a transparent platen for reading the image on the document is moved across the entire surface of the platen in any case. Namely, it is not rational that, even when the given document is small in size, the entire area of the platen is optically scanned for reading the image like a document of large size is copied. The copying speed would be increased if only the document reading area defined on the platen is scanned in accordance with the size of the given document.

OBJECT OF THE INVENTION

This invention is made to eliminate the drawbacks suffered by the conventional automatic document feeding device as described above and has an object to provide a recirculation-type document feeding device for a copying machine, which can automatically feed a plurality of original documents to be copied from a document tray to a document setting portion defined on a platen one by one and permit the document after copying to be alternatively sent to the document tray or discharged to a document discharge tray, so as to arbitrarily take out one or more copied documents with ease.

Another object of the present invention is to provide a simple and compact automatic document feeding device capable of copying consecutively not merely simplex documents but also duplex documents so as to readily prepare, for example, one or more volumes of booklets or books.

Still another object of the present invention is to provide an automatic document feeding device capable of rationally scanning a reading area defined on a platen in accordance with the size of a given original document to be copied.

SUMMARY OF THE INVENTION

To attain the objects described above according to the present invention, there is provided a recirculation-type document feeding device for a copying machine, which comprises a document supply means for transferring given documents to be copied from a document tray to a document setting portion defined on a platen one by one, a document discharge means for transferring the document from the document setting portion toward a document outlet through a discharge passage defined above at least one part of the document setting portion, a discharge tray facing the document outlet and located above at least one part of the discharge passage, a return passage extending from the document outlet to the document tray, and at least one reversible switchback roller located adjacent to the document outlet.

Prior to copying, one of the given documents is drawn out from the document stack on the document tray and fed to the document setting portion on the platen by the document supply means. After copying, the copied document is sent out from the document setting portion on the platen to the discharge tray through the discharge passage and document outlet by driving the document discharge means.

In a case of copying one or more original documents one time, the switchback roller rotates forward only so as to discharge the copied document to the discharge tray through the document outlet.

When a plurality of given documents are repeatedly copied two or more times, the switchback roller once rotates forward to send partly the copied documents out of the document outlet, and then, reverses to send backward the copied documents into the return passage toward the document tray. Thus, the copied document is returned to the document tray in the same posture as it was initially put on the document tray and again fed to the document setting portion to repeat copying required times.

When the copying was carried out required times, the switchback roller does no longer reverse but rotate forward to send out the copied documents to the discharge tray. Also at this time, the copied documents are consecutively discharged to the discharge tray in the same order as it was initially put on the document tray.

When one set of documents are consecutively discharged to the discharge tray upon completion of copying required times, the document tray becomes empty so as to enable another set of documents to place thereon without removing the copied documents discharged to the discharge tray. The latter set of documents are finally sent back to the document tray after completion of copying.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The other objects and features of the present invention will be hereinafter explained in detail with reference to the accompanying drawings, wherein.

DESCRIPTION OF THE PREFERRED EMBODIMENTS

Figure 1:
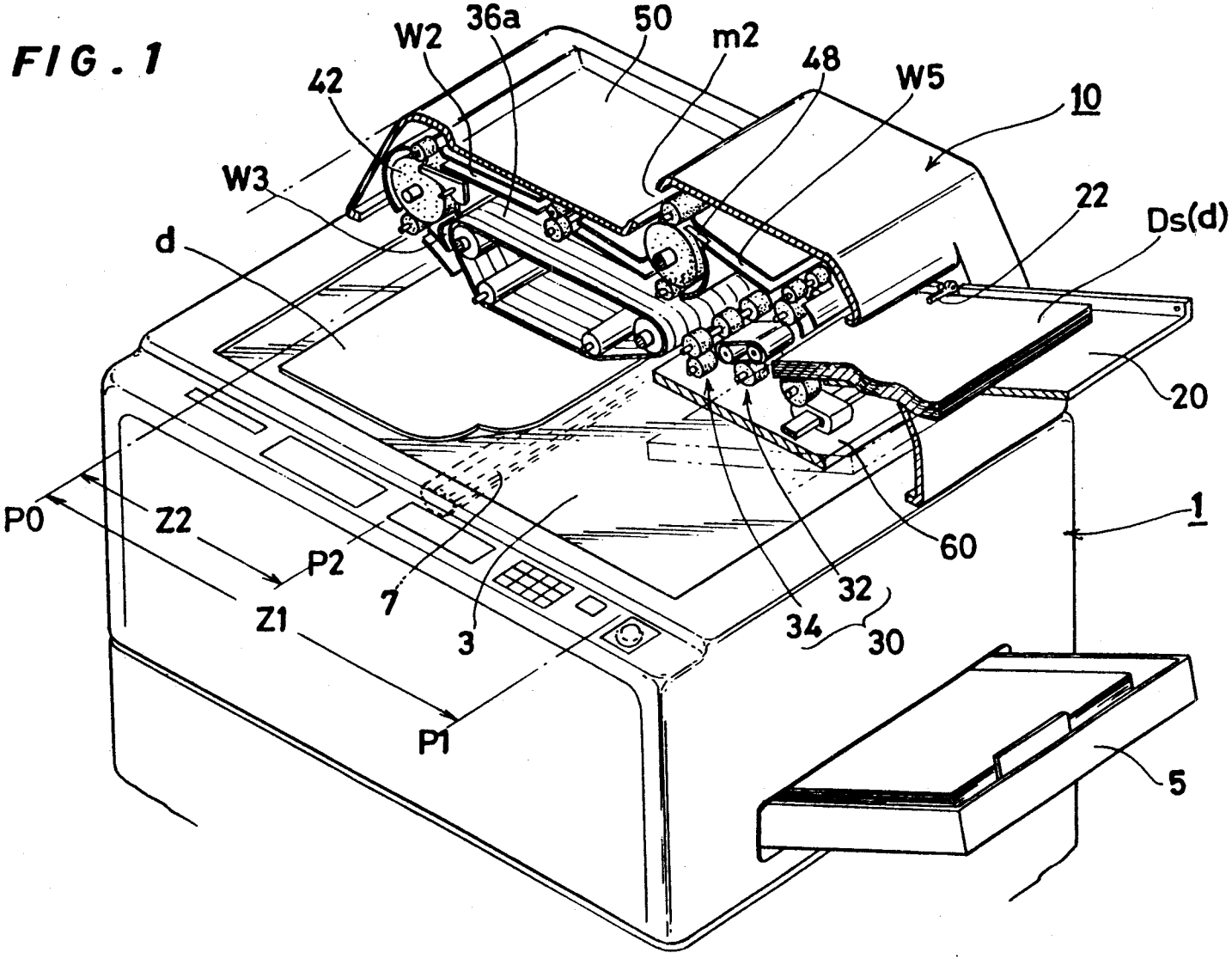
FIG. 1 is a perspective view showing one embodiment of the recirculation-type automatic document feeding device according to this invention, which is applied to a copying machine as one example.
Figure 2:
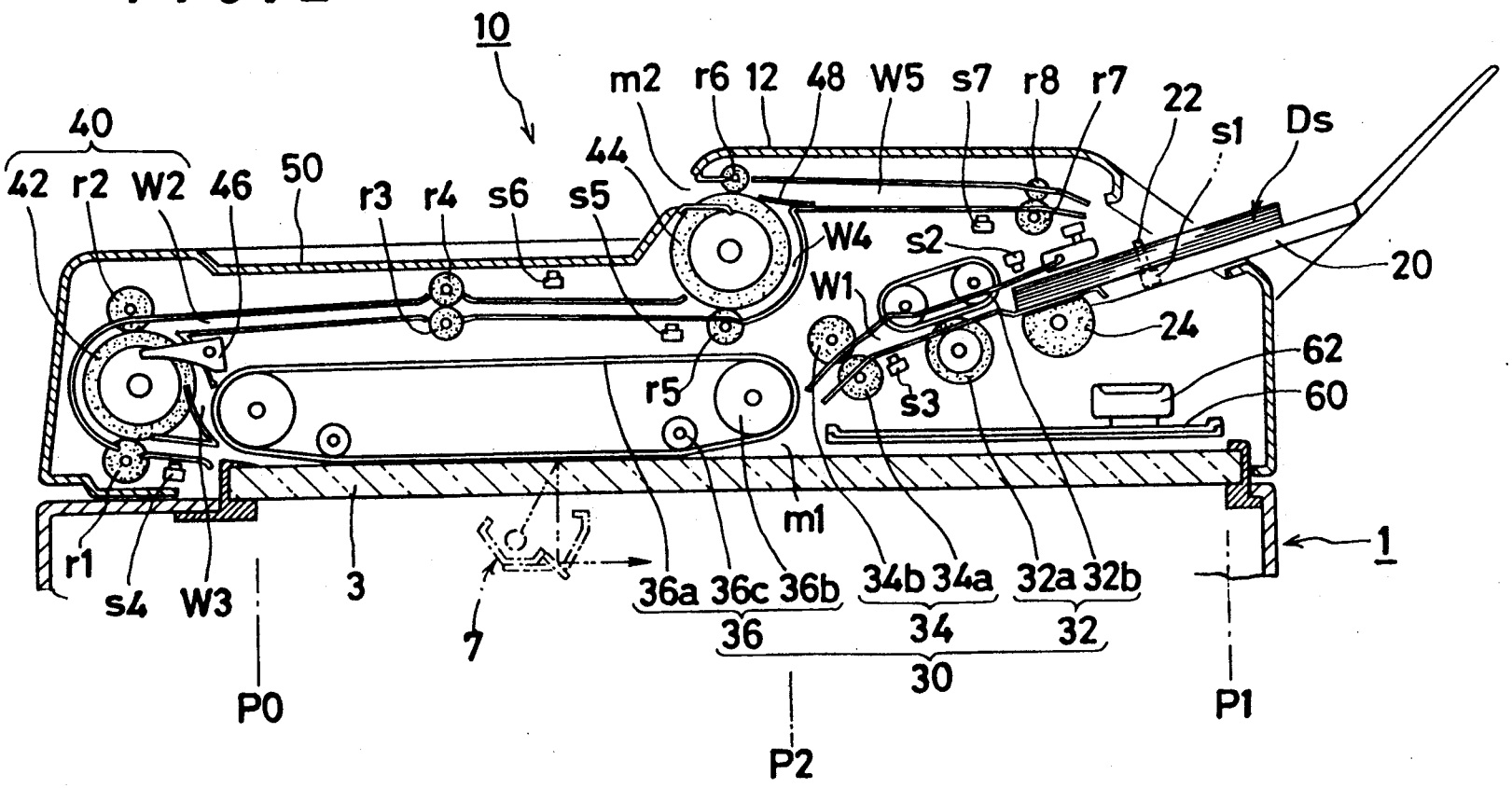
FIG. 2 is a side sectional view showing the device of FIG. 1.

One embodiment of the recirculation-type automatic document feeding device according to this invention which is applied to a copying machine is illustrated in FIG. 1. The copying machine 1 has a platen 3 such as of a glass plate on which a document setting portion is defined, a copying sheet cassette 5 attached into the side of the copying machine 1, and an optical scanning system 7 disposed under the platen 3. The optical scanning system 7 extends horizontally in the direction perpendicular to a document feeding direction (lengthwise direction of the platen 3) and is movable in the document feeding direction across a copying effective area Z1 which is defined on the platen 3 and has an image reading reference point Po at its front end. When copying, a given original document (d) to be copied is usually placed on the platen 3 in such a state that the leading end of the document agrees with the reading reference point Po. In the illustrated embodiment, the area Z1 between the points Po–P1 which is the substantially entire upper surface of the platen 3 is determined for a document of large size (e.g. A3-size sheet), and the half area Z2 between the reference point Po and the midpoint P2 is determined for a document of small size (e.g. A4-size sheet).

The document feeding device 10 is mounted on the copying machine 1 so as to cover the document setting portion on the platen 3 in an upward openable state by hinge means.

The document feeding device 10 comprises a document tray 20 on which one or more given original documents (Ds) to be copied are stacked, a document supply means 30 for transferring the documents from the document tray 20 one by one to the document setting portion on the platen 3 through a supply passage W1 and a document inlet ml, a document discharge means 40 including at least one discharge roller 42 and a discharge passage W2, at least one switchback roller 44 defining a document passage W4 half round the roller 44 and forming a document outlet m2 at the terminal of the passage W4 leading to the discharge passage W2, and a return passage W5 extending from the document outlet m2 to the document tray 20. The document outlet m2 and switchback roller 44 are disposed about above the midst of the document setting portion on the platen 3.

The elements including the document supply means 30, document discharge means 40, and return passage W5 are contained within a casing 12. On the casing 12, a discharge tray 50 facing the document outlet m2 is formed above at least one part of the platen 3.

That is, the given original document (d) is fed to the document setting portion on the platen 3 through the supply passage W1 to be copied there. After copying, the copied document (d) is sent out by driving the document discharge means 40 and the switchback roller 44. In a case of copying two or more times, the copied document is sent back to the document tray 20 through the return Passage W5.

The document tray 20 has a recirculation sensor s1 which is operated by a switch lever 22 which initially comes into contact with the uppermost of the documents when stacked on the document tray 20. The document tray is further provided under its bottom plate with at least one document drawing roller 24 having a sector cut portion. The drawing roller 24 is at a stop in its normal state while keeping the sector cut portion thereof parallel to the bottom plate of the document tray 20. When giving an instruction of a copying operation to the copying machine, the drawing roller 24 moves and comes into contact with the lowermost of the documents stacked on the document tray 20, consequently forwarding the lowermost document out of the document stack Ds.

The document tray 20 is provided at its front end portion with an empty sensor s2 for confirming the existence of the document on the document tray 20. When the sensor s2 detect no document on the document tray, the copy machine assumes its deactivated state even if receiving the copying instruction.

The document inlet ml is located about at the midpoint P2 in the copying effective area Z1. The document supply means 30 with the supply passage W1 formed from the document tray 20 to the document inlet ml comprises a document separation means 32 having a function of permitting only one of the documents drawn out from the document tray 20 to pass therethrough, and a skew correction means 34 composed of one or more pair of skew correction rollers 34*a* and 34*b* for correcting inclination of the document being fed through the supply passage W1.

The aforenoted document separation means 32 comprises at least one feed roller 32*a* rotatable in the forward direction and at least one document separation belt 32*b* which is in light contact with the feed roller 32*a* and rotates at low speed in the opposite direction relative to the feed roller 32*a*.

The paired skew correction rollers 34*a* and 34*b* are under a stop for a time until the document (d) being transferred through the supply passage W1 comes into slight touch with the rollers 34*a* and 34*b*. Immediately after the document (d) sent from the document tray touches the rollers 34*a* and 34*b*, the skew correction rollers 34*a* and 34*b* start to rotate in the direction in which the document is forwarded. Even if the document (d) advances aslant relative to the document feeding direction, it is adjusted to advance straight. The operation of the rollers 34*a* and 34*b* are controlled by a skew correction sensor s3.

The recirculation sensor s1, drawing roller 24, document separation means 32, and skew correction means 34 as illustrated by way of example are commonly adopted in conventional document feeders of this type, and therefore, these elements will not be described in detail and should not be understood as limitative.

The document supply means 30 includes a document transfer means 36 covering the area Z2 substantially half the area Z1, which extends from the midpoint P2 at which the document inlet ml is located to the reference point Po (exit of the document setting portion) on the platen 3. With the document transfer means 36, the document introduced into the document setting portion defined between the transfer means 36 and the platen 3 is moved along the document setting portion.

The document transfer means 36 in this embodiment is composed of at least one endless belt 36*a*, drive pulleys 36*b* for driving the endless belt 36*a*, and press rollers 36*c* for bringing the endless belt 36*a* into resilient contact with the platen 3.

Between the reference point Po defined on the platen 3 and the discharge roller 42, there is mounted a set sensor s4 for detecting the document passing by the sensor s4 to control the operation of the discharge roller 42.

In the straight path of the passage W2 between the discharge roller 42 and the switchback roller 44, a switchback sensor s5 is disposed close to the switchback roller 44 for detecting the document passing by the sensor s5 to control the rotation of the switchback roller 44.

The discharge passage W2 is diverged to form a turn passage W3 half round the discharge roller 42. About a diverging point of the passages W2 and W3, there is disposed at least one turnover gate 46 for allowing the document fed from the document setting portion on the platen 3 to alternatively advance toward the document outlet m2 through the document passage W4 or return to the document setting portion.

Under the discharge tray 50 facing the outlet m2, a discharge sensor s6 is mounted for confirming the existence of the document on the discharge tray 50. When the document being discharged to the discharge tray 50 is detected by the discharge sensor s6, an optical or audio alarm signal may be issued.

The return passage W5 is diverged from the passage W4, and at the diverging point of the passages W4 and W5, there is disposed at least one directional gate 48 made of a resilient sheet such as Mylar. The resilient gate 48 extends parallel to the passage W5 toward the switchback roller 44. The free end of the gate 48 comes into light touch with the switchback roller 44, so that, once the document sent from the passage W4 passes through the gate 48, it is prevented from returning back to the passage W4 if the switchback roller 44 reverses.

In the passage W5, there is mounted a return sensor s7 for detecting the document passing through the passage W5. When the document advancing along the passage W5 is detected by the return sensor s7, the speed at which the document is fed is reduced.

In the drawings, reference symbols r1 and r2 denote press rollers being in frictional contact with the discharge roller 42; r3 and r4 denote feed rollers disposed in the discharge passage W2; r5 and r6 denote press rollers being in frictional contact with the switchback roller 44; and r7 and r8 denote feed rollers disposed in the return passage W5.

Over the area between Pl and P2 on the platen 3 other than the area Z2 covered with the document transfer means 36, there is disposed a pressure cover 60 which is vertically movable by an electromotive lift 62. Under normal conditions, the pressure cover 60 is raised and slightly separated from the platen 3. When the document of large size is copied, it is permitted to enter between the pressure cover 60 and the platen 3 and pressed against the platen 3 by lowering the pressure cover 60.

With the document feeding device 10 having the mechanism noted above, one or more original documents can be subjected to simplex or duplex copying one or more times. Moreover, the original documents of different sizes can be rationally dealt with. The principle of fulfilling these functions according to the present invention will be described hereinafter with reference to FIGS. 3 through 6.

[ONE-TIME SIMPLEX COPYING]: FIGS. 3A to 3D show the process in which a plurality of original documents of small size each having an image to be copied on one side are subjected to simplex copying one time.

Figure 3A:
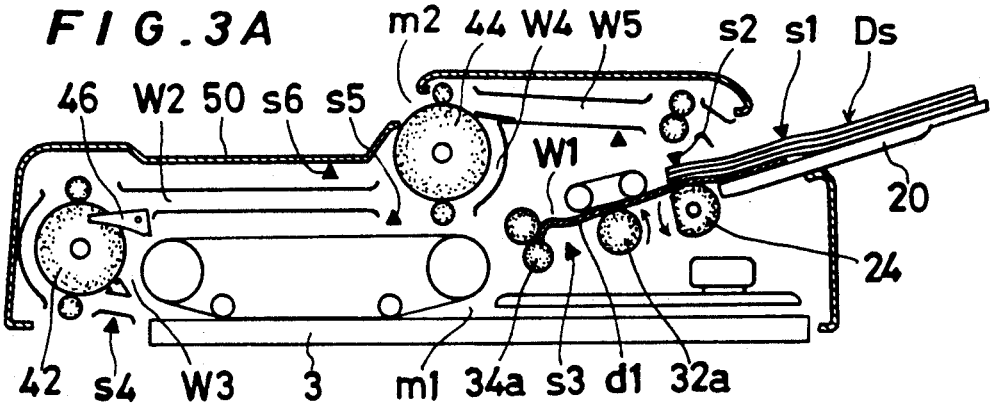
FIGS. 3A through 3D are explanatory views showing in side elevation a process in which given documents are respectively copied once.

Upon stacking the documents (document stack Ds) of small size on the document tray 20, an instruction of a copying operation is given to the copying machine. Then, the drawing roller 24 rotates to cause the lowermost document (first document) d1 to be drawn out from the document stack Ds and forwarded along the document supply passage W1. The document d1 sent out from the document tray 20 advances and comes into collision with the paired skew correction rollers 34*a* and 34*b* which do not yet rotate. Consequently, the collision of the document d1 with the skew correction rollers makes the leading end of the document bent slightly to effect skew correction as shown in FIG. 3A.

Figure 3B:
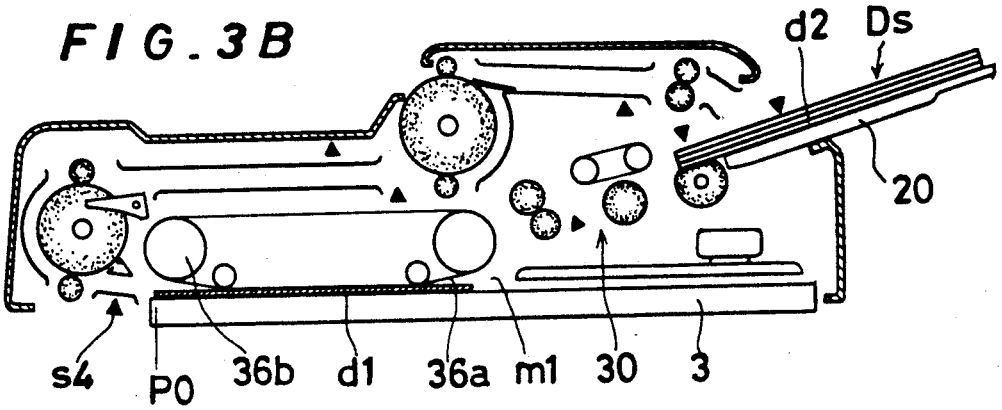

Thereafter, the document d1 is introduced into the document setting portion between the platen 3 and the endless belt 36*a* and forwarded by driving the document transfer means 36 until the leading end of the document d1 arrives the reference point Po defined on the platen 3. The document d1 set in position in the document setting portion is scanned by the optical scanning system 7 to be copied. (FIG. 3B)

Figure 3C:
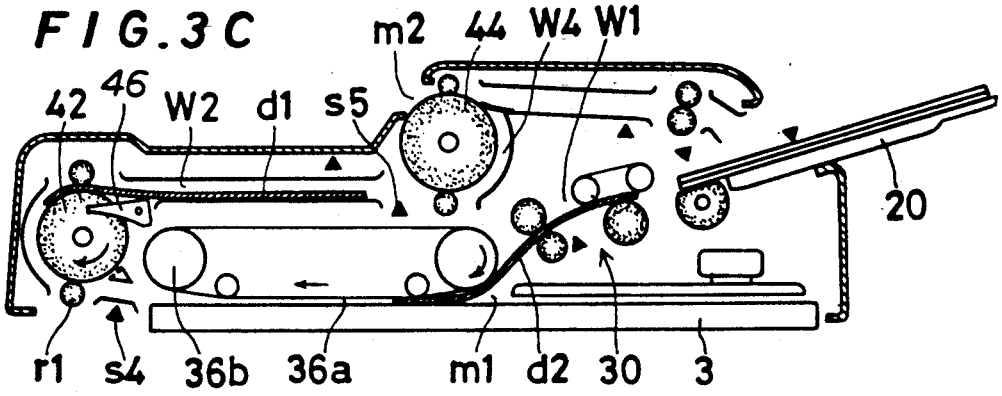

After copying, the copied document d1 is sent out from the document setting portion on the platen 3 by driving synchronously the document transfer means 36 and the discharge roller 42. At this time, the turnover gate is open to the straight path of the discharge passage W2 so that the document d1 advances horizontally toward the passage W4 defined half round the switchback roller 44 as shown in FIG. 3C.

While forwarding the copied document d1 along the discharge passage W2, the second document d2 is drawn out from the document stack Ds on the document tray 20 and introduced into the document setting portion on the platen through the supply passage W1.

Figure 3D:
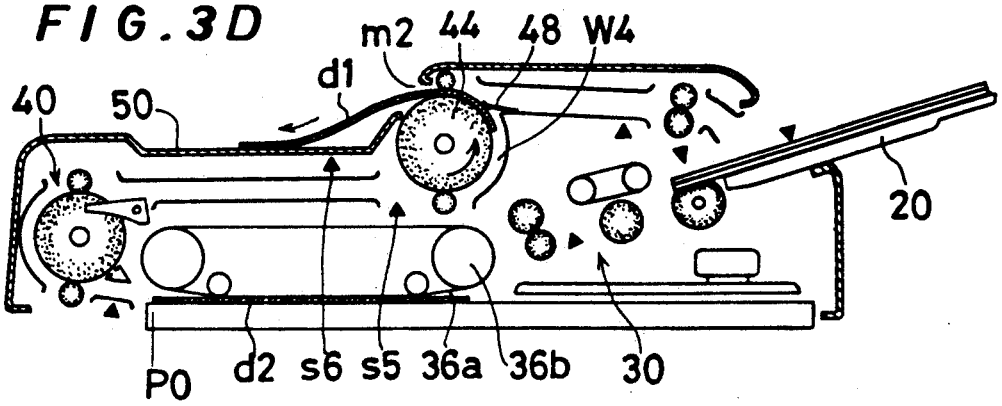

The first document d1 advancing along the discharge passage W2 leading to the passage W4 is introduced into the passage W4 by driving the rollers r3 and r4 and the switchback roller 44, and then, eliminated to the discharge tray 50 through the outlet m2. (FIG. 3D)

The second and subsequent documents are dealt with one by one in the same manner as the first document d1.

After the documents first set on the document tray 20 are all copied and finally discharged to the discharge tray 50, if another set of documents are set on the document tray 20 and an instruction of the copying operation is given to the copying machine, each document of the second set is also handled in the same manner as the first set of documents which are still left on the discharge tray 50.

The copied document discharged to the discharge tray 50 does not turn upside down relative to the same document initially set on the document tray 20.

Figure 4A:
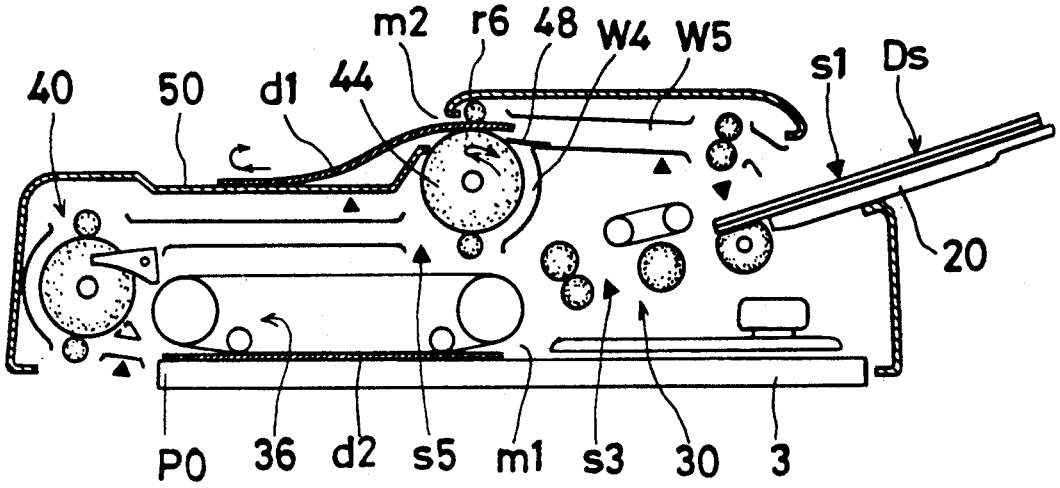
FIGS. 4A and 4B are explanatory views showing a process in which documents of small size are copied repeatedly.
Figure 4B:
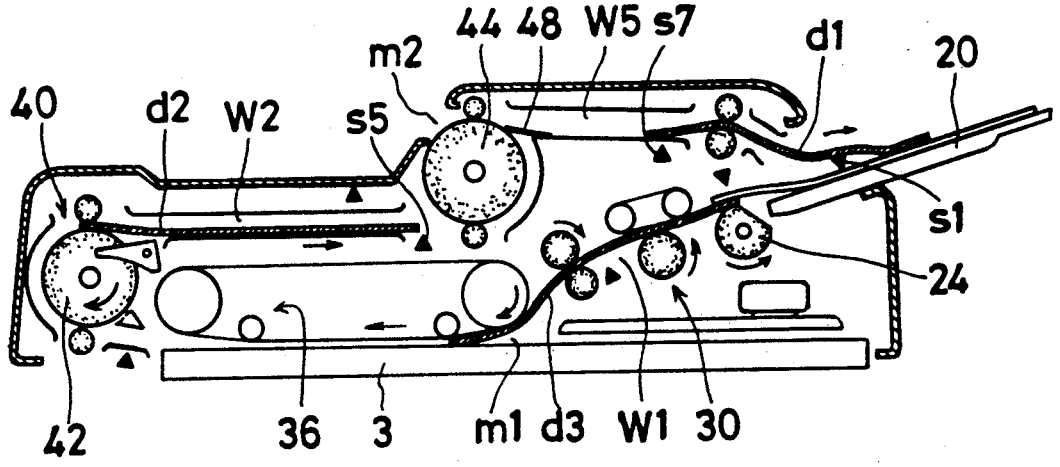

That is to say, when each document of the second set passes through the directional gate 48, the switchback roller 44 is reversed to introduce the document which has been partially discharged out through the document outlet m2 into the return passage W5 as shown in FIG. 4A. Though the copied document returning to the document tray 20 lies on the remaining documents of the second set, the copied document is distinctively divided by the switch lever 22 of the recirculation sensor s1 as shown in FIG. 4B. Thus, the second set of documents after copying can be returned to the document tray in the same state as those initially stacked thereon.

[REPEATED SIMPLEX COPYING]: FIGS. 4A and 4B show the process in which a plurality of original documents of small size each having an image to be copied on one side are repeatedly subjected to simplex copying two or more times.

The documents stacked on the document tray 20 are handled to be copied in the manner illustrated in series from FIGS. 3A through 3C to FIGS. 4A and 4B.

During the copying operation, each document stacked on the document tray 20 is transferred through the passages W1, W2 and W4 as shown in FIGS. 3A to 3D. After a fixed length of time from passing the tail end of the document by the switchback sensor s5, the switchback roller 44 which has rotated forward up to this time is reversed in the manner touched upon above with reference to FIG. 4A. To be more specific, immediately after the tail end of the document d1 advancing along the passage W4 passes through the directional gate 48, the switchback roller 44 is rotated in the reverse direction as shown in FIG. 4A. Thus, the document d1 is introduced into the return passage W5 so as to return to the document tray 20 as shown in FIG. 4B. As is seen in the drawings, the second and subsequent documents d2, d3 . . . are simultaneously handled together with the first document d1.

The documents sent back to the document tray 20 are repeatedly subjected to the simplex copying required times, while keeping count of the documents returning to the document tray 20 by the recirculation sensor s1. After completely copying required times, the documents are discharged to the discharge tray 50 through the document outlet m2.

Thus, required sets of copied matters can be obtained automatically in the same order of page as the given documents. Since the given documents are switched in advancing direction by the switchback roller 44, they can return to the document tray 20 without turning upside down relative to the initial posture in the documents stacked on the document tray 20.

Figure 5A:
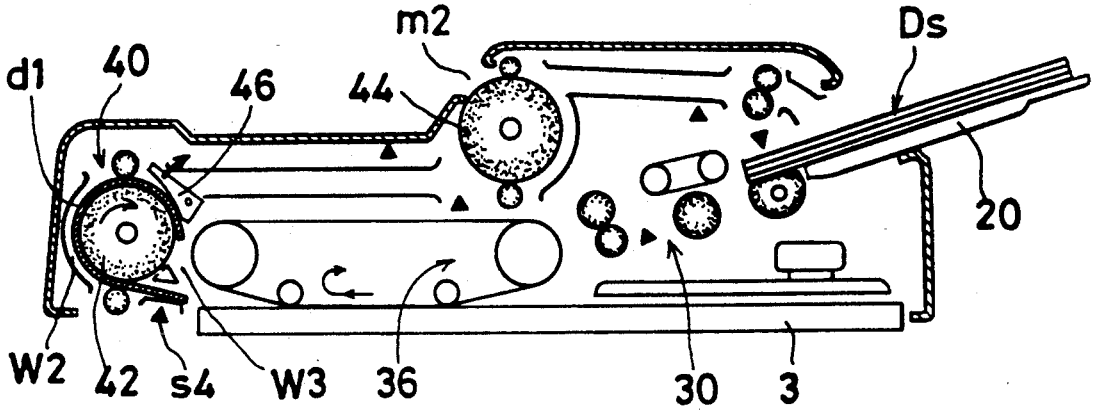
FIGS. 5A through 5C are explanatory views showing a process in which documents of small size are subjected to duplex copying.
Figure 5B:
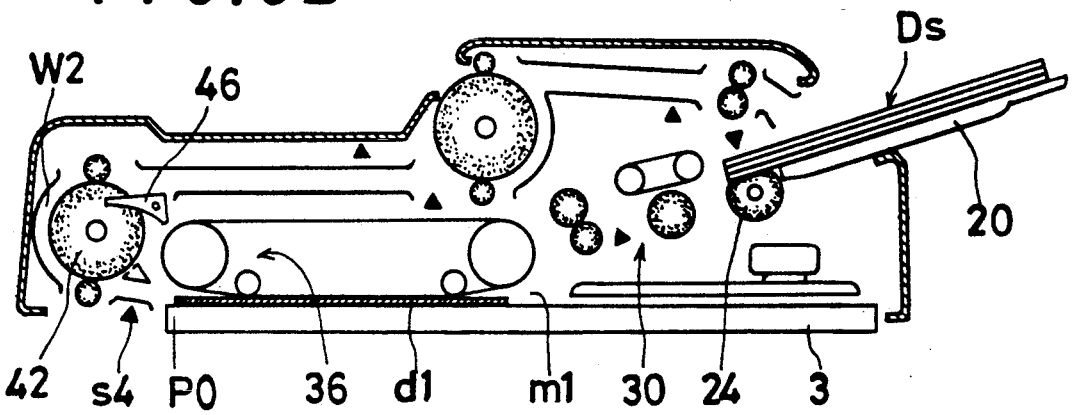
Figure 5C:
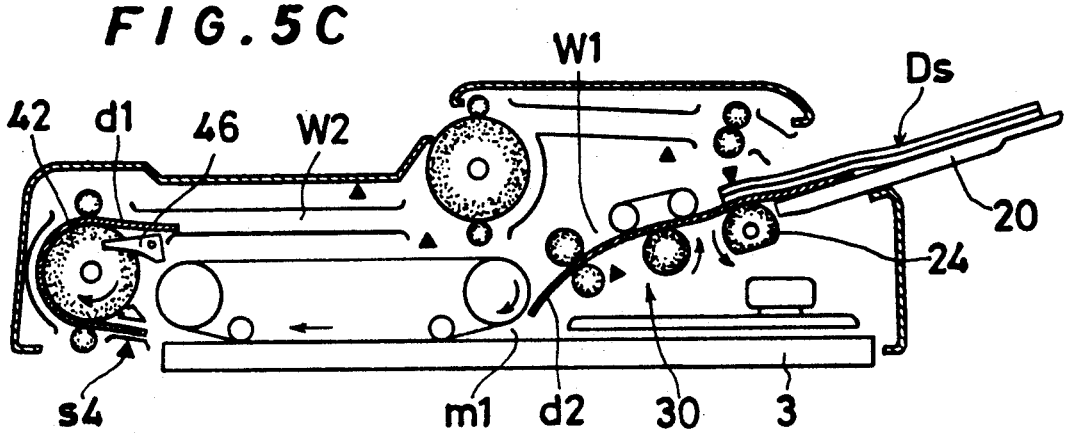

[REPEATED DUPLEX COPYING]: FIGS. 5A to 5C show the process in which a plurality of original documents of small size each having images to be copied on both sides are repeatedly subjected to duplex copying two or more times.

Also in the case of copying the given duplex document having the images on both sides, copying of the first surface of the duplex document is carried out in the same manner as that of copying the simplex document as shown in FIGS. 3A and 3B.

When the copying of the first surface of the document d1 is finished in the document setting portion defined on the platen 3, the document d1 is sent out from the document setting portion by the document transfer means 36 and introduced into the discharge passage W2 round the discharge roller 42. At this time, the turnover gate 46 is actuated to close the straight path of the discharge passage W2 and open the turn passage W3. Therefore, the document d1 entering into the discharge passage W2 is introduced into the turn passage W3 as shown in FIG. 5A. Then, the document d1 is turned upside down and sent back into the document setting portion on the platen 3 as shown in FIG. 5B, so as to copy the second surface of the document d1.

After copying the both sides of the document d1 as noted above, the document is discharged from the document setting portion on the platen 3 and introduced into the discharge passage W2 by synchronously driving the document transfer means 36 and the discharge roller 42 as shown in FIG. 5C. At this time, the second document d2 is being introduced into the document setting portion on the platen 3 through the document supply passage W1. After this, the copied document d1 is discharged to the discharge tray 50 through the passage W4 and the document outlet m2. In the case that the given documents are copied two or more times, the documents may be sent back to the document tray 20 by controlling the switchback roller 44 in the manner shown in FIGS. 4A and 4B.

[COPYING OF LARGE SIZE DOCUMENTS]: FIGS. 6A to 6D show the process in which a plurality of original documents of large size are subjected to simplex copying.

Figure 6A:
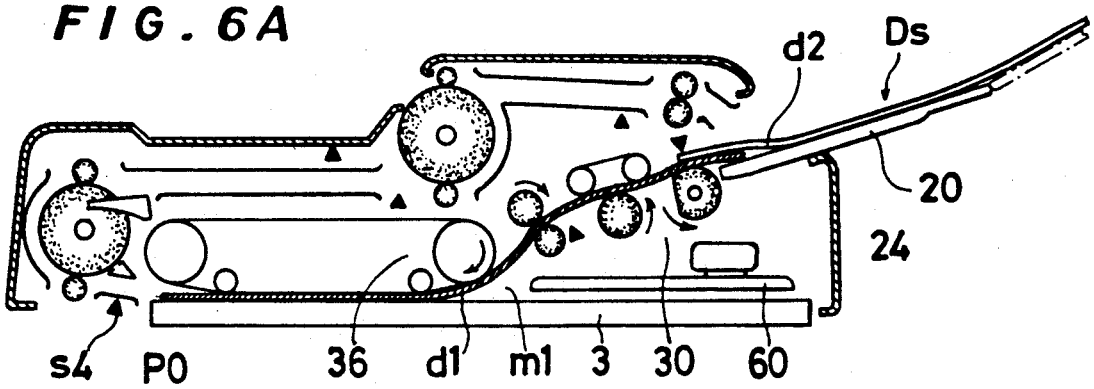
FIGS. 6A through 6D are explanatory views showing a process in which documents of large size are copied.
Figure 6B:
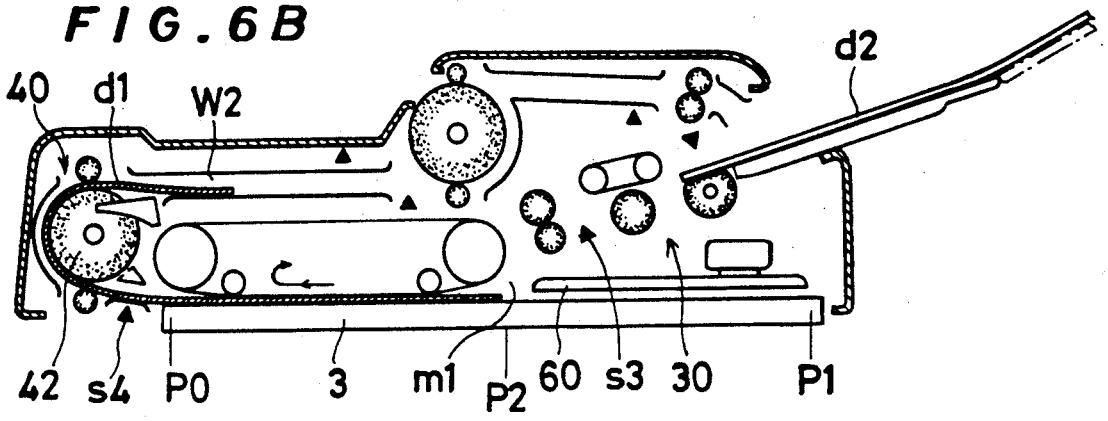
Figure 6C:
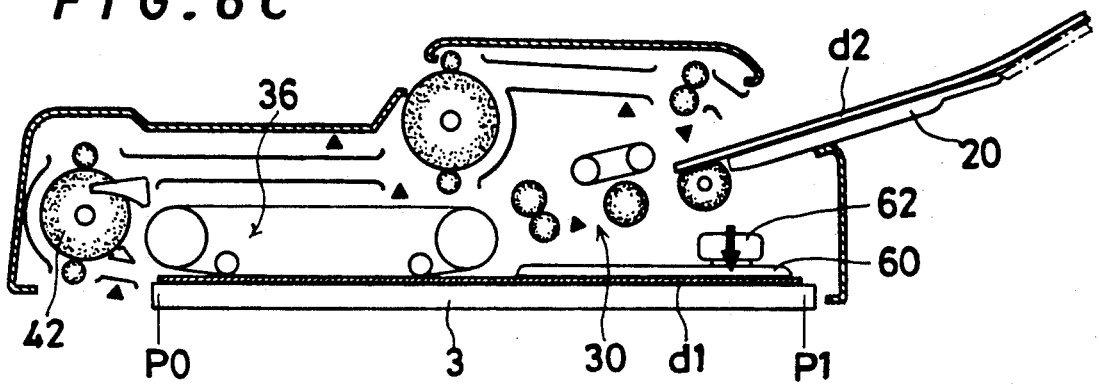

As illustrated in FIG. 6A, the documents of large size which are stacked on the document tray 20 are drawn out one by one by rotating the drawing roller 24 and sent forward to the document setting portion on the platen 3 through the document supply passage W1 in the same manner as described above with reference to FIG. 3A. Even if the leading end of the document d1 arrives the reference point Po, the document d1 is further forwarded to the discharge passage W2 by driving the document transfer means 36 and the discharge roller 42. When the tail end of the document d1 falls into the document inlet m1 to come into contact with the platen 3 as shown in FIG. 6B, the document transfer means 36 and the discharge roller 42 are synchronously reversed to move the document d1 backward and allow the tail end of the document d1 to enter between the platen 3 and the pressure cover 60 until the leading end of the document aligns with the reference point Po. When the document d1 takes its copying position on the platen, the lift 62 is actuated to lower the pressure cover 60. While pressing the document d1 against the platen 3 with the pressure cover 60, the copying operation is carried out as shown in FIG. 6C.

Figure 6D:
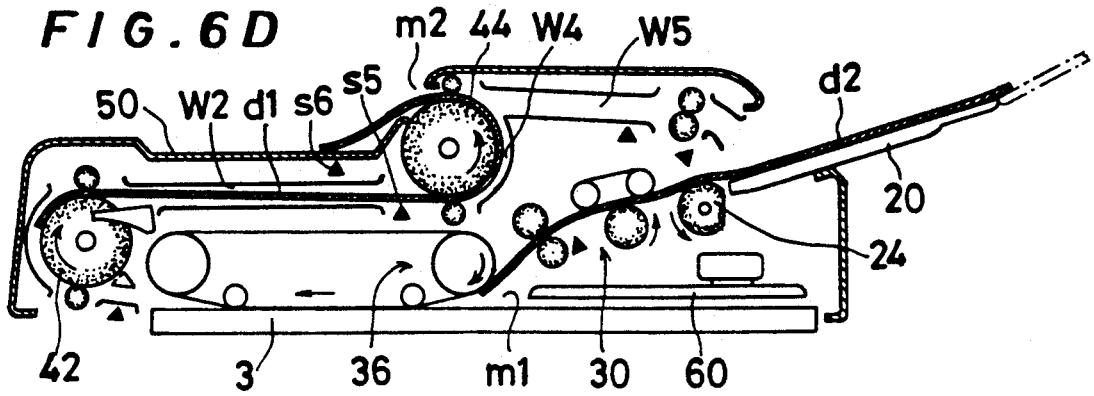

After copying, the pressure cover 60 is raised, and the document transfer means 36 and the discharge roller 42 are driven to send out the copied document on the platen 3 to the discharge passage W2 and discharge it from the document outlet m2 to the discharge tray 50 through the passage W4 as shown in FIG. 6D. While sending out the first document d1 to the discharge tray 50, the second document d2 is introduced into the document setting portion on the platen.

If the document of large size is required to be copied once again, the document may be sent back to the document tray 20 in the same way as described above with reference to FIG. 4A. Namely, the switchback roller 44 is reversed to introduce the document d1 into the return passage W5 when the tail end of the document d1 passes through the directional gate 48. Thus, determination as to whether the document is alternatively discharged to the discharge tray 50 or returned to the document tray 20 can be made automatically or arbitrarily.

As is apparent from the foregoing, according to the document feeding device of this invention, since given original documents are sent one by one to a document setting portion on a platen to be copied and automatically return to a document tray after copying, the documents can be copied any number of times and return to the document tray in the same order of page as those initially set on the document tray. Because, after completing the copying of the documents, the copied documents are discharged to the discharge tray, they can be easily distinguished from uncopied documents still remaining on the document tray and advantageously taken out even in the midst of the copying operation as occasion arises. Besides, this document feeding device has an advantage in that, even if the copied documents are left on the discharge tray, another set of documents can be set on the document tray and dealt with.

Moreover, the automatic document feeding device of this invention fulfills an excellent function of not only automatic simplex copying but also automatic duplex copying and can rationally scan a copying area defined on the platen in accordance with the size of the given document to be copied. Thus, since, in addition to the fact that the given document can be rationally scanned, the discharge passage and the discharge tray to which the document is sent out through the discharge passage are arranged above the document setting portion defined on the platen, the device can be reduced in size and weight.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

What is claimed is:

1. A recirculation-type document feeding device for a copying machine having a platen on which a document setting portion is defined, comprising a document tray for stacking one or more given documents to be copied thereon, means for transferring the documents from said document tray to said document setting portion one by one, a discharge passage leading to said document setting portion and adapted for transferring the document, said discharge passage being defined above at least one part of said document setting portion and having a document outlet, means for discharging the document from said document setting portion toward said document outlet through said discharge passage, a discharge tray facing said document outlet and located above at least one part of said discharge passage, a return passage extending from said document outlet to said document tray, and at least one reversible switchback roller located adjacent to said document outlet, said document outlet and switchback roller being disposed about above a midpoint of said document setting portion, whereby the given document transferred from said document tray to said discharge passage is alternatively discharged to said discharge tray or returned to said document tray by controlling said switchback roller.

2. The device according to claim 1, wherein said document discharge means includes at least one discharge roller, said discharge passage being formed to extend about said discharge roller such that said discharge passage extends approximately half-way around said discharge roller, and further comprising a turn passage which is diverged from said discharge passage and formed approximately another half-way around said discharge roller and at least one turnover gate disposed at a diverging point of said discharge passage and turn passage so as to alternatively forward the document from said document setting portion toward said document outlet or return to said document setting portion on the platen.

3. The device according to claim 1 wherein said document supply means includes document transfer means covering at least a part of said document setting portion on the platen, and further comprising a pressure cover disposed above the remaining part of said document setting portion and means for vertically moving said pressure cover so as to be alternatively separated from said platen to allow the document to enter between said platen and pressure cover, or lowered to press the document against said platen.

4. A recirculation-type document feeding device for a copying machine having a platen on which a document setting portion having a copying reference point is defined, comprising a document tray for stacking one or more given documents to be copied thereon, means for transferring the documents from said document tray to said document setting portion one by one, discharge passage for transferring the document and having a document outlet, said discharge passage being disposed above at least one part of said document setting portion, means for transferring the document from said document setting portion toward said document outlet through said discharge Passage, a discharge tray facing said document outlet and disposed above at least one part of said discharge passage, a return passage extending from said document outlet to said document tray, and means for allowing the document sent from said discharge passage to alternatively be discharged to said discharge tray or returned to said document tray.

5. A recirculation-type document feeding device for a copying machine having a platen on which a document setting portion is defined, comprising a document tray disposed above said document setting portion for stacking one or more given documents to be copied thereon, means for transferring the documents from said document tray to said document setting portion one by one, a discharge passage leading to said document setting portion and adapted for transferring the document, said discharge passage being defined above at least one part of said document setting portion and having a document outlet, means for discharging the document from said document setting portion toward said document outlet through said discharge passage, a discharge tray facing said document outlet and located above at least one part of said discharge passage, said discharge tray disposed abreast of said document tray above said document setting portion, a return passage extending from said document outlet to said document tray, and at least one reversible switchback roller located adjacent to said document outlet, said document outlet and switchback roller being disposed about above a midpoint of said document setting portion, whereby the given document transferred from said document tray to said discharge passage is alternatively discharged to said discharge tray or returned to said document tray by controlling said switchback roller.

6. A recirculation-type document feeding device for a copying machine having a platen on which a document setting portion is defined, comprising a document tray disposed above said document setting portion for stacking one or more given documents to be copied thereon, means for transferring the documents from said document tray to said document setting portion one by one, said means for transferring the documents having at least one endless belt mounted in face contact with said platen and covering at least one part of said document setting portion so as to define a document inlet about at a midpoint of said document setting portion ,through which one of the documents stacked on said document tray is introduced into said document setting portion, a discharge passage leading to said document setting portion and adapted for transferring the document, sad discharge passage being defined above at least one part of said document setting portion and having a document outlet, means for discharging the document from said document setting portion toward said document outlet through said discharge passage, a discharge tray facing said document outlet and located above at least one part of said discharge passage, said discharge tray disposed abreast of said document tray above said document setting portion, a return passage extending from said document outlet to said document tray, and at least one reversible switchback roller located adjacent to said document outlet, whereby the given document transferred from said document tray to said discharge passage is alternatively discharged to said discharge tray or returned to said document tray by controlling said switchback roller.

7. A recirculation-type document feeding device for a copying machine having a platen on which a document setting portion is defined, comprising a document tray disposed above said document setting portion for stacking one or more given documents to be copied thereon, means for transferring the documents from said document tray to said document setting portion one by one, said means for transferring the documents having at least one endless belt mounted in face contact with said platen and covering at least one part of said document setting portion so as to define a document inlet about at a midpoint of said document setting portion, through which one of the documents stacked on said document tray is introduced into said document setting portion, a discharge passage leading to said document setting portion and adapted for transferring the document, said discharge passage being defined above at least one part of said document setting portion and having a document outlet, means for discharging the document from said document setting portion toward said document outlet through said discharge passage, a discharge tray facing said document outlet and located above at least one part of said discharge passage, said discharge tray disposed abreast of said document tray above said document setting portion, a return passage extending from said document outlet to said document tray, at least one reversible switchback roller located adjacent to said document outlet, and a vertically movable pressure cover disposed above the remaining part of said document setting portion covered with said endless belt, said document outlet and switchback roller being disposed about above a midpoint of said document setting portion, whereby the given document transferred from said document tray to said discharge passage is alternatively discharged to said discharge tray or returned to said document tray by controlling said switchback roller.

* * * * *